US008137482B2

(12) United States Patent
Jo et al.

(10) Patent No.: US 8,137,482 B2
(45) Date of Patent: Mar. 20, 2012

(54) CARBURIZATION HEAT TREATMENT METHOD AND METHOD OF USE

(75) Inventors: Bong Lae Jo, Gyeonggi-do (KR); Chang Won Kang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 524 days.

(21) Appl. No.: 12/356,492

(22) Filed: Jan. 20, 2009

(65) Prior Publication Data

US 2009/0308497 A1 Dec. 17, 2009

(30) Foreign Application Priority Data

Sep. 5, 2008 (KR) ..... 10-2008-0087666

(51) Int. Cl.
*C23C 8/22* (2006.01)

(52) U.S. Cl. ..... 148/233; 148/319

(58) Field of Classification Search ..... 148/233, 148/319
See application file for complete search history.

(56) References Cited

U.S. PATENT DOCUMENTS 6,187,111 B1 2/2001 Waka et al.

FOREIGN PATENT DOCUMENTS

JP 08-109435 A 4/1996

*Primary Examiner* — Jessee R. Roe
(74) *Attorney, Agent, or Firm* — Edwards Wildman Palmer LLP; Peter F. Corless

(57) ABSTRACT

Disclosed is a carburization heat treatment method including carburizing a workpiece at a relatively low temperature within a temperature range of $A_1$~$A_3$ using a vacuum carburizing furnace and then performing quenching using a high-pressure gas, in which the workpiece is made of typical carburizing alloy steel having a carbon content of about 0.10~0.35 wt %. This method can be applied to carburization heat treatment of a steel workpiece sensitive to heat deformation, such as an annulus gear, in lieu of a conventional gas carburization method using plug quenching.

6 Claims, 2 Drawing Sheets

CARBURIZATION HEAT TREATMENT METHOD AND METHOD OF USE

CROSS-REFERENCE TO RELATED APPLICATIONS

This application claims under 35 U.S.C. §119(a) priority to Korean Application No. 10-2008-0087666, filed on Sep. 5, 2008, the disclosure of which is incorporated herein by reference in its entirety.

BACKGROUND OF THE INVENTION

1. Field of the Invention

The present invention relates to a carburization heat treatment method of a vehicle workpiece that has a shape that is sensitive to heat deformation, such as an annulus gear of a vehicle transmission. The invention also relates to a vehicle workpiece carburized using the method.

2. Background Art

Generally, a vehicle transmission gear is a workpiece that is used for directly transferring engine power to a vehicle power system, and requires high fatigue strength. Thus, the transmission gear is carburized, quenched and thermally treated in order to improve fatigue strength through surface hardening.

Presently, a gas carburization heat treatment method results in the formation of an abnormal surface layer 15~25 μm thick which decreases durability on the surface of a workpiece and also results in abnormal heat deformation due to non-uniform cooling as quenching is carried out using an oil or a salt bath.

An annulus gear for an automatic transmission has a ring-type structure having internal teeth 1 as shown in FIG. 1. This structure is considerably sensitive or weak to heat in terms of the shape deformation. For example, when the annulus gear is subjected to gas carburization heat treatment, the ring shape becomes distorted or the shape of the teeth can be changed. As a result, the heat deformation causes abnormal assembly of an annulus gear into a transmission or abnormal noise in an assembled state.

Accordingly, the carburization heat treatment of the annulus gear is presently performed through a series of procedures of gas carburization to a surface, slow cooling, high-frequency heating, followed by plug quenching. The plug quenching is a process for quenching a workpiece which is held at various positions using a jig to prevent heat deformation. However, the plug quenching process is not applied to simultaneous treatment of a plurality of workpieces but instead to individual treatment of such workpieces, and thus can lead to lowered productivity and increased heat treatment costs.

Recently, the industry is increasingly using a vacuum carburization method. The vacuum carburization method, as compared to a gas carburization method using plug quenching, is advantageous in terms of high productivity and is considerably favorable for maintaining the shape of the teeth of, for example an annulus gear. However, when using the conventional vacuum carburization method, the shape of the annulus gear is considerably distorted upon cooling.

The above information disclosed in this the Background section is only for enhancement of understanding of the background of the invention and therefore it may contain information that does not form the prior art that is already known in this country to a person of ordinary skill in the art.

SUMMARY OF THE INVENTION

In one aspect, the present invention provides a carburization heat treatment method which is suitable for use in a vehicle workpiece sensitive to heat deformation, such as an annulus gear, and is capable of reducing heat deformation.

In another aspect, the present invention provides a carburization heat treatment method, which can preferably be used in lieu of a conventional gas carburization method using plug quenching.

In one preferred embodiment, the present invention provides a carburization heat treatment method, which results in suitably high productivity.

According to preferred embodiments of the present invention, a carburization heat treatment method preferably comprises suitably heating a workpiece to a carburizing temperature within a temperature range of $A_1$~$A_3$, carburizing the surface of the workpiece in the presence of a carburizing gas, and suitably quenching the workpiece using a high-pressure gas so that the surface of the workpiece is formed with martensite and the core thereof is formed with a mixture of martensite and initial ferrite which is not subjected to phase transformation.

In preferred embodiments, the workpiece is preferably made of typical carburizing alloy steel, including, but not limited only to, chromium alloy steel, chromium-molybdenum alloy steel, or chromium-nickel-molybdenum alloy steel, each of which has a carbon content of 0.10~0.35 wt %, and the above procedures are preferably conducted in a vacuum atmosphere using a vacuum carburizing furnace.

In further preferred embodiments, the workpiece may be an annulus gear used for a planetary gear set of a transmission.

In further related embodiments, the workpiece may have a carbon content of 0.15~0.25 wt %, and may be made of any one or more steel material selected from, but not limited only to, among SCr420H, SCM420H, SNCM420H, ASTM 4120, ASTM5120, and ASTM8620.

In other further related embodiments, the carburizing temperature may be set within a temperature range allowing the workpiece to have 30~70% of ferrite, and in further embodiments, preferably 30~50% of ferrite.

In still further embodiments, according to the present invention, a vehicle workpiece preferably comprises a surface having a mixture of martensite and residual austenite and a core having a mixture of 30~50% of ferrite and the balance of martensite, in which the ferrite contains at least 30% of initial ferrite not subjected to phase transformation during carburization heat treatment.

In preferred embodiments, the carburization heat treatment suitably includes using a vacuum carburizing furnace carburization in a temperature range of $A_1$~$A_3$ and then suitably quenching, and the workpiece is made of typical carburizing alloy steel, including, but not limited to, chromium alloy steel, chromium-molybdenum alloy steel, or chromium-nickel-molybdenum alloy steel, each of which has a carbon content of 0.10~0.35 wt %.

According to further embodiments, the workpiece may preferably be an annulus gear for a transmission made of any one or more steel material selected from, but not limited to, among SCr420H, SCM420H, SNCM420H, ASTM 4120, ASTM5120, and ASTM8620.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
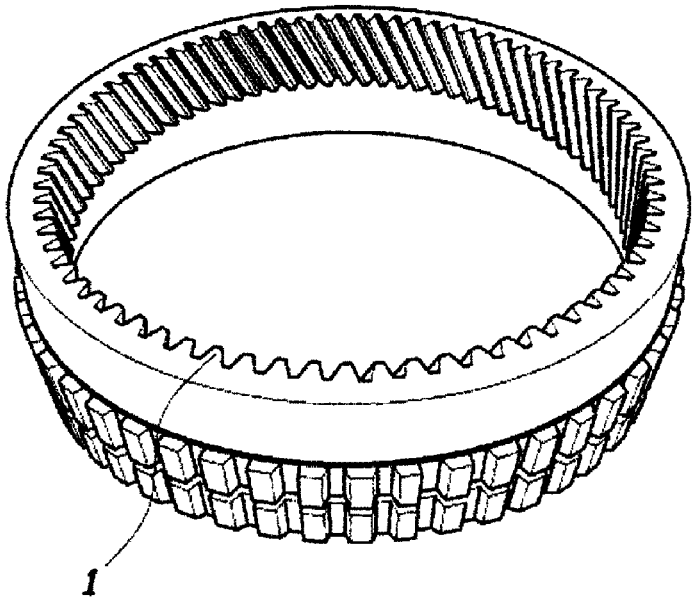
FIG. 1 shows a photograph of a typical annulus gear.

As described herein, the present invention includes a carburization heat treatment method of a vehicle workpiece sensitive to heat deformation, comprising heating the workpiece to a carburizing temperature within a temperature range of $A_1$~$A_3$, carburizing a surface of the workpiece in presence of a carburizing gas, and quenching the workpiece using a high-pressure gas, wherein the workpiece is made of carburizing alloy steel.

In one embodiment, the step of quenching the workpiece using a high-pressure gas is carried out so that the surface of the workpiece is formed with martensite and a core thereof is formed with a mixture of martensite and initial ferrite which is not subjected to phase transformation.

In another embodiment, the carburizing alloy steel is selected from one or more of the group consisting of chromium alloy steel, chromium-molybdenum alloy steel and chromium-nickel-molybdenum alloy steel.

In another related embodiment, the carburizing alloy steel has a carbon content of 0.10~0.35 wt %

In another further embodiment, the method is conducted in a vacuum atmosphere using a vacuum carburizing furnace.

In still another embodiment, the workpiece has a carbon content of 015~0.25 wt %.

In a further related embodiment, the workpiece is made of a steel material selected from one or more of the group consisting of SCr420H, SCM420H, SNCM420H, ASTM 4120, ASTM5120, and ASTM8620.

In another aspect, the invention features a vehicle workpiece carburized for surface hardening, comprising a surface and a core, wherein the carburization heat treatment comprises using a vacuum carburizing furnace carburization within a temperature range of $A_1$~$A_3$ and then quenching, and the workpiece is made of carburizing alloy steel.

In one embodiment, the surface has a mixture of martensite and residual austenite.

In another embodiment, the core has a mixture of 30~50% of ferrite and a balance of martensite.

In another related embodiment, the ferrite contains at least 30% of initial ferrite not subjected to phase transformation during carburization heat treatment.

In still a further related embodiment, the carburizing alloy steel is selected from one or more of the group consisting of chromium alloy steel, chromium-molybdenum alloy steel and chromium-nickel-molybdenum alloy steel.

In another embodiment, the carburizing alloy steel has a carbon content of 0.10~0.35 wt %

The invention also features a motor vehicle comprising the vehicle workpiece as described in any of the aspects or embodiments herein.

Hereinafter, a detailed description will be given of the present invention, with reference to the appended drawings.

A target which is to be carburized according to preferred embodiments of the present invention is described below.

According to preferred embodiments of the present invention, the target is a vehicle workpiece made of typical carburizing alloy steel, including, but not limited to, chromium alloy steel, chromium-molybdenum alloy steel, or chromium-nickel-molybdenum alloy steel. In certain embodiments, the carburizing alloy steel as described herein has a carbon content of 0.10~0.35 wt %. In preferred embodiments of the present invention, the term "typical carburizing alloy steel" indicates a suitable standard carburizing alloy steel according to KS, JS, or ASTM. In particular preferred embodiments, the carburizing alloy steel according to the present invention does not undergo specific alloy treatment to increase an $A_3$ temperature and preferably has an $A_3$ or $A_{c3}$ temperature of about 820~830° C.

According preferred embodiments of the invention, a target to be carburized according to the present invention is mainly a gear workpiece for a transmission, which is preferably made of typical carburizing alloy steel having a carbon content of about 0.15~0.25 wt %, preferably for example, an annulus gear surrounding planetary gears. Preferably, in certain embodiments, examples of a suitable material for the gear workpiece include, but are not limited to, SCr420H, SCM420H, and SNCM420H according to KS, and ASTM 4120, ASTM5120, and ASTM8620 according to ASTM. For reference, Table 1 shows the wt % compositions of SCr420H, SCM420H, and SNCM420H.

TABLE 1

| Composition | C | Si | Mn | P, S | Ni | Cr | Mo | Fe |
|---|---|---|---|---|---|---|---|---|
| SCr420H | 0.17~0.23 | 0.15~0.35 | 0.55~0.95 | 0.030 or less | — | 0.85~1.25 | — | Balance |
| SCM420H | 0.17~0.23 | 0.15~0.35 | 0.55~0.95 | 0.030 or less | — | 0.85~1.25 | 0.15~0.35 | Balance |
| SNCM420H | 0.17~0.23 | 0.15~0.35 | 0.40~0.70 | 0.030 or less | 1.55~2.00 | 0.35~0.65 | 0.15~0.30 | Balance |

In further embodiments of the invention, the carburization heat treatment process of a workpiece having the above composition is carried out as described below.

Figure 2:
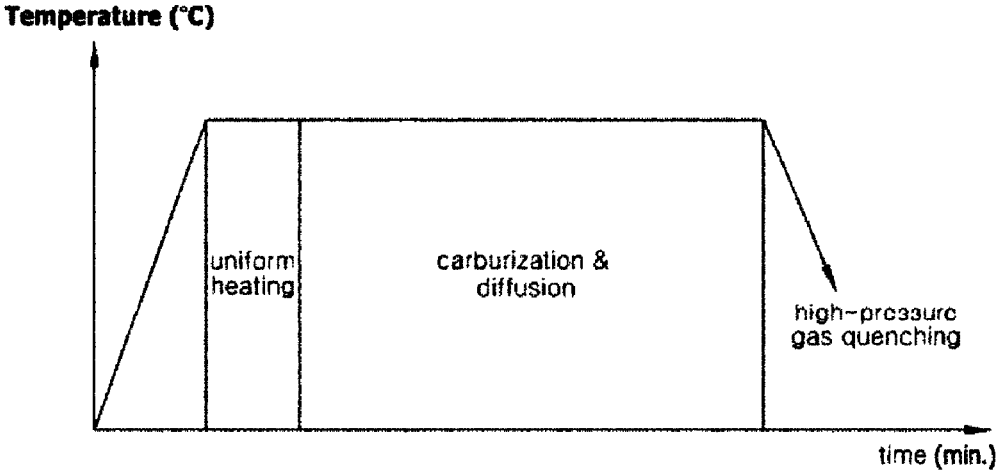
FIG. 2 shows a carburization heat treatment process according to an embodiment of the present invention.
Figure 3:
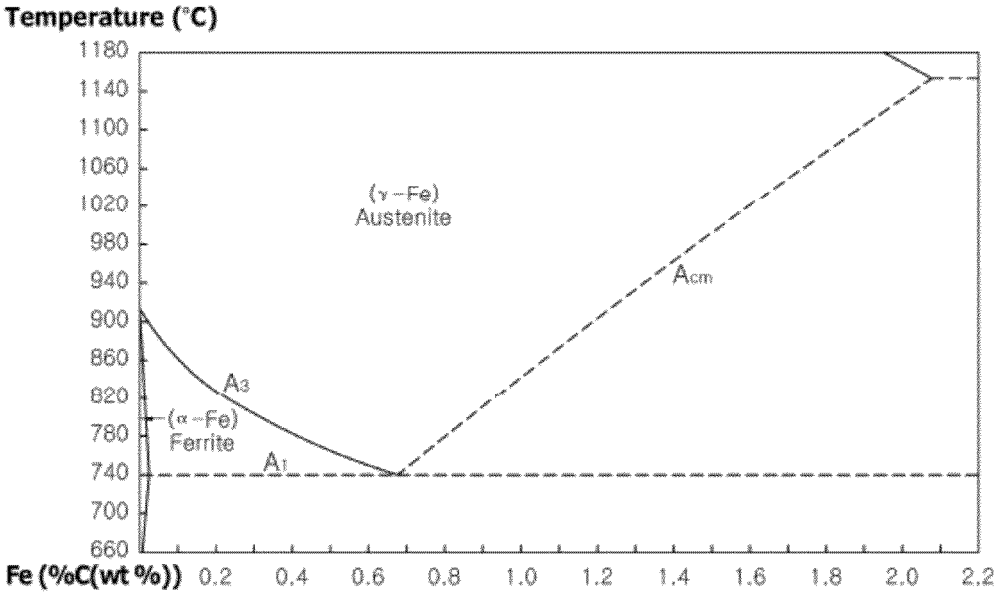
FIG. 3 shows a typical Fe—C phase equilibrium diagram.

In preferred embodiments, the carburization heat treatment process according to the present invention is suitably performed in a vacuum atmosphere using a vacuum carburizing furnace. Preferably, the vacuum atmosphere indicates a low-temperature oxygen-free atmosphere, namely, conditions which are suitably controlled in a state of low oxygen partial pressure and reduced pressure in order to prevent the oxidation of the surface of the workpiece during carburization heat treatment. Preferably, such carburization heat treatment includes a series of procedures of heating, carburization, and quenching using high-pressure gas as shown in FIG. 2. Referring to FIGS. 2 and 3, each procedure is suitably specified.

(i) Heating

According to preferred embodiments of the invention, and As shown in FIG. 2, a workpiece is preferably heated to a carburizing temperature within the temperature range of $A_1$~$A_3$ in a vacuum carburizing furnace and then maintained or soaked at that temperature. According to further embodiments, lots of workpieces are loaded at once into a vacuum carburizing furnace. Accordingly, because the furnace has different temperatures depending on the positions thereof in the furnace, the workpieces loaded into the furnace should be sufficiently soaked so as to have a suitably uniform temperature. Accordingly, the period of time required to heat the workpiece is suitably determined in consideration of heat deformation and productivity, and the soaking time is suitably set in the range from about 30 min to about 1 hour.

According to further embodiments of the invention, the carburizing workpiece preferably has a mixture of pearlite and ferrite at room temperature. When such a workpiece is soaked in the temperature range of $A_1$~$A_3$, substantially all or all of pearlite is transformed into austenite at room temperature. Also, only a part of ferrite is transformed into austenite at room temperature, and the other part thereof (i.e., initial ferrite) is not transformed but remains as it is. According to certain embodiments, the heated workpiece has a mixture of austenite and ferrite. Accordingly, the workpiece has 30~70% of ferrite at a carburizing temperature, as described herein. Preferably, taking into consideration these properties, the carburizing temperature should be suitably determined.

(ii) Carburization

According to preferred embodiments of the invention, a conventional gas or vacuum carburization process is characterized in that it is preferably performed at a temperature substantially equal to, equal to, or higher than $A_3$, suitably corresponding to an austenite single-phase region. According to certain preferred embodiments of the present invention, the carburization process is preferably conducted within the temperature range of $A_1$~$A_3$ corresponding to a dual-phase region in which austenite ($\gamma$) and ferrite ($\alpha$) coexist. As is generally known, $A_1$ is preferably a temperature at which austenite is suitably transformed into ferrite and cementite, and $A_3$ is an austenitizing temperature.

According to further embodiments, when a carburizing gas such as acetylene gas or ethylene gas is preferably supplied into the chamber of the vacuum carburizing furnace in which the workpiece is disposed, the workpiece is subjected to carburization and diffusion of carbon. In further embodiments, the surface of the workpiece subjected to carburization and diffusion of carbon is suitably austenitized owing to an increase in carbon concentration, whereas the core of the workpiece at which the diffusion of carbon does not arrive has a mixture of austenite and ferrite corresponding to the microstructure after the heating process. Accordingly, in preferred embodiments, the proportion of ferrite in the core is estimated to be about 30~70%.

(iii) Quenching

According to exemplary embodiments, the carburized workpiece is preferably quenched up to a temperature (Ms) that suitably initiates transformation into martensite using a high-pressure gas. Accordingly, in further exemplary embodiments, an initial cooling speed is preferably maintained, preferably to at least 12° C./sec. In certain exemplary embodiments, examples of the gas include, but are not limited to, nitrogen, helium, and hydrogen. According to preferred embodiments of the present invention, a quenching process using an oil or a salt bath is not used because a workpiece is deformed attributable to nonuniform cooling. Preferably, the surface of the quenched workpiece has a mixture of martensite and residual austenite, and the core thereof has a mixture of initial ferrite and martensite.

According to further preferred embodiments, the core of the quenched workpiece is required to have about 30%, 35%, 40%, 45%, 50%, 55%, 60%, 65%, 70% ferrite, and preferably 30~70% of ferrite. In one embodiment, if the proportion of ferrite of the core thereof is less than 30%, the deformation is suitably increased due to phase transformation, and thus an effect of reducing heat deformation of a workpiece becomes insignificant. According to other embodiments, if the proportion of ferrite of the core thereof exceeds 70%, heat deformation is effectively reduced but hardness and toughness of the core do not reach the level required for a vehicle workpiece to be suitably carburized, for example, a gear for a transmission. According to further preferred embodiments, in the case where the above workpiece is especially an annulus gear, the core thereof may have about 30~50% of ferrite.

According to certain preferred embodiments of the present invention, furnace cooling is not additionally applied to the carburized workpiece before the quenching process. Accordingly, the furnace cooling used in a conventional carburization heat treatment method plays a role of lowering the starting point of the quenching temperature to suitably reduce heat deformation of a workpiece. Preferably, according to exemplary embodiments of the present invention, the carburizing temperature is set to about 800° C., which is suitably lower than a conventional temperature (for example, about 920° C.), and accordingly the need for furnace cooling is considerably reduced. In further preferred embodiments, if there is no necessity for consideration of extremely high productivity, furnace cooling may be preferably performed before quenching to suitably improve quality.

In certain examples, for example in the case where a conventional gas or vacuum carburization process is used, ferrite and martensite are preferably allowed to coexist in the core of the carburized workpiece. In certain embodiments, a target is preferably carburized at a suitable temperature corresponding to an austenite ($\gamma$) single-phase region, preferably maintained at a temperature corresponding to a dual-phase region ($\gamma+\alpha$) through furnace cooling, and then quenched, thereby creating a mixture of martensite and ferrite. According to further related embodiments, this ferrite results from primary transformation into austenite during carburization and then secondary transformation into ferrite during furnace cooling and quenching, causing the distortion of the shape of the target.

EXPERIMENTAL EXAMPLE

According to exemplary embodiments of the invention, and in order to evaluate availability of carburization heat treatment according to the present invention, an annulus gear was manufactured using SCr420H having a composition as shown in Table 2 below, carburized, and then measured for the cylindricity (deviation from the perfect cylindrical shape of a workpiece) and the degree of roundness (deviation from the perfect round of a workpiece).

TABLE 2

| Composition | C | Si | Mn | P | S | Cr | Fe |
|---|---|---|---|---|---|---|---|
| Amount (wt %) | 0.19 | 0.28 | 0.71 | 0.01 | 0.01 | 0.95 | Balance |

Experimental conditions used in exemplary embodiments described herein are summarized in Table 3 below. Although soaking was not additionally shown in Table 3, it was conducted at a suitable carburizing temperature as shown in Table 3 for 30 min or longer. In Examples 1 to 3 SCr420H was subjected to vacuum carburization at 770~810° C. within the temperature range of $A_1$~$A_3$ and then quenched. In Comparative Example 1 carburization at 920° C. (which is higher than an $A_3$ temperature) and then quenching were conducted according to a conventional vacuum carburization method. In Comparative Example 2 gas carburization at 920° C. (which is higher than an $A_3$ temperature), cooling, high-frequency heating and then plug quenching were conducted according to a conventional gas carburization method.

TABLE 3

| | Carburization Heat Treatment Conditions | Cylindricity | Degree of Roundness |
|---|---|---|---|
| Ex. 1 | Vacuum Carburization & Diffusion (770° C.) → High-Pressure Gas Cooling (17 bar, Nitrogen) | 60 | 76 |
| Ex. 2 | Vacuum Carburization & Diffusion (790° C.) → Furnace Cooling (770° C.) → High-Pressure Gas Cooling (17 bar, Nitrogen) | 62 | 77 |
| Ex. 3 | Vacuum Carburization & Diffusion (810° C.) → Furnace Cooling (770° C.) → High-Pressure Gas Cooling (17 bar, Nitrogen) | 64 | 80 |
| C. Ex. 1 | Vacuum Carburization & Diffusion (920° C.) → Furnace Cooling (780° C.) → High-Pressure Gas Cooling (17 bar, Nitrogen) | 82 | 89 |
| C. Ex. 2 | Gas Carburization & Diffusion (920° C.) → Furnace Cooling (up to 500° C.) → Extraction → High-Frequency Heating (850° C.) → Plug Quenching (Oil Quenching) | 54 | 72 |

As is apparent from the experimental results of Table 3, in Examples 1 to 3, the degree of roundness and cylindricity were appropriately equivalent to those in Comparative Example 2 using a jig and were superior to those in Comparative Example 1. For reference, the degree of roundness and cylindricity are represented in units of μm. When these values are decreased, heat deformation is evaluated to be low.

Figure 4:
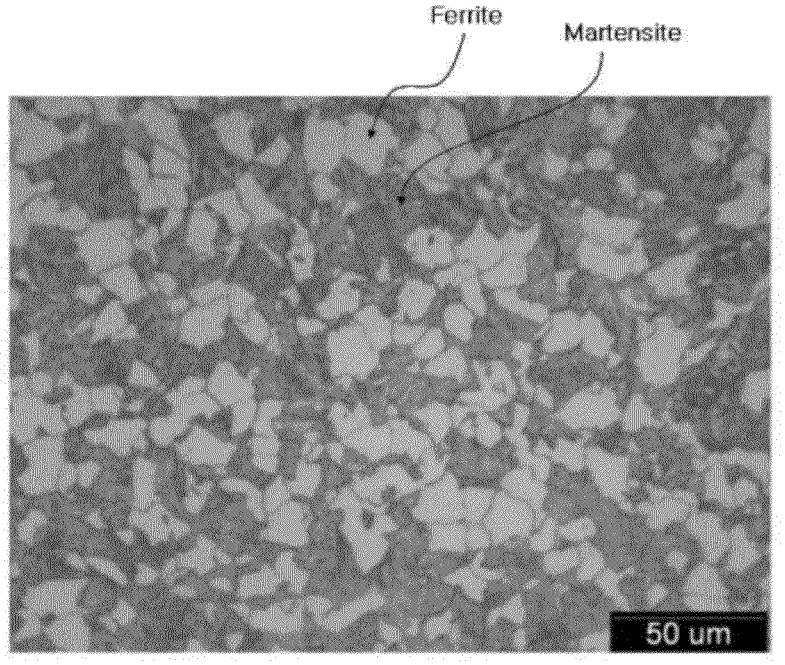
FIG. 4 shows a photograph of the core of the annulus gear which is carburized according to the embodiment of the present invention.

FIG. 4 shows a photograph of the microstructure of the core of Example 2, which is a mixture of ferrite (bright portion) and martensite (dark portion). This ferrite is initial ferrite before carburization heat treatment, which was not subjected to phase transformation during the quenching process.

As described herein, the present invention provides a carburization heat treatment method and a vehicle workpiece carburized using the method. According to preferred embodiments of the present invention, carburization treatment can be suitably performed within the temperature range of $A_1$~$A_3$ which is considerably lower compared to a conventional gas or vacuum carburization process requiring a temperature equal to or higher than $A_3$ which is an austenitizing temperature. Thus, according to preferred embodiments of the invention described herein, upon quenching, the distortion of the shape of the workpiece is suitably reduced.

In the core of the workpiece carburized according to the present invention, initial ferrite (which is a room-temperature structure before carburization heat treatment) not subjected to phase transformation during carburization heat treatment is suitably maintained in a predetermined proportion or more, thus advantageously retaining the initial shape of the workpiece and suitably reducing heat deformation.

According to further preferred embodiments, lots of workpieces are loaded into a vacuum carburizing furnace, after which carburization heat treatment can be continuously performed, resulting in increased productivity, compared to a conventional gas carburization method.

According to other further preferred embodiments, the carburization heat treatment method according to the present invention results in suitably reduced heat deformation of a workpiece and increased productivity, and thus can be used in lieu of a conventional gas carburization method.

According to other further preferred embodiments, the workpiece carburized according to the present invention is superior in terms of strength, in particular, fatigue strength, and has almost the same shape as the shape before carburization heat treatment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A carburization heat treatment method of a vehicle workpiece sensitive to heat deformation, comprising:

heating the workpiece to a carburizing temperature within a temperature range of $A_1$~$A_3$;

carburizing a surface of the workpiece in presence of a carburizing gas; and quenching the workpiece using a high-pressure gas so that the surface of the workpiece is formed with martensite and a core thereof is formed with a mixture of martensite and initial ferrite which is not subjected to phase transformation;

wherein the workpiece is made of carburizing alloy steel, including chromium alloy steel, chromium-molybdenum alloy steel, or chromium-nickel-molybdenum alloy steel, each of which has a carbon content of 0.10~0.35 wt %, and the method is conducted in a vacuum atmosphere using a vacuum carburizing furnace.

2. The method as set forth in claim 1, wherein the workpiece has a carbon content of 0.15~0.25 wt %.

3. The method as set forth in claim 1, wherein the workpiece is made of a steel material selected from the group consisting of: SCr420H, SCM420H, SNCM420H, ASTM 4120, ASTM5120, and ASTM8620.

4. The method as set forth in claim 1, wherein the workpiece is an annulus gear for a vehicle transmission.

5. The method as set forth in claim 1, wherein the carburizing temperature is set within a temperature range allowing the workpiece to have 30~70% of ferrite.

6. The method as set forth in claim 1, wherein the carburizing temperature is set within a temperature range allowing the workpiece to have 30~50% of ferrite.

* * * * *